US005637252A

United States Patent [19]

Johnson et al.

[11] Patent Number: 5,637,252

[45] Date of Patent: Jun. 10, 1997

[54] INHIBITOR FOR AQUEOUS LIQUID DEOXIDIZING COMPOSITION AND PROCESS FOR ALUMINUM, WITH REDUCED ETCHING OF TITANIUM

[75] Inventors: Philip M. Johnson, Southfield; Lawrence R. Carlson, Waterford, both of Mich.

[73] Assignee: Henkel Corporation, Plymouth Meeting, Pa.

[21] Appl. No.: 592,993

[22] Filed: Jan. 29, 1996

[51] Int. Cl.[6] ..... C09K 13/08

[52] U.S. Cl. ..... 252/79.3; 252/79.2; 134/3; 216/102; 216/103; 216/104

[58] Field of Search ..... 252/79.3, 79.4; 216/102, 103, 104

[56] References Cited

U.S. PATENT DOCUMENTS 5,052,421 10/1991 McMillen ..... 134/2

*Primary Examiner*—R. Bruce Breneman

*Assistant Examiner*—Michael E. Adjodha

*Attorney, Agent, or Firm*—Ernest G. Szoke; Wayne C. Jaeschke; Norvell E. Widsom, Jr.

[57] ABSTRACT

A chromium-and-ferricyanide non-aqueous cleaner/deoxidizer for aluminum, the cleaner/deoxidizer having an etch rate on titanium that is low enough for practical use in processes where aluminum objects to be deoxidized are held on titanium racks or hangers during the process, combines boric acid, fluoborate anions, and an acid that is stronger than either of boric and fluoboric acids, usually also with an oxidizing agent such as hydrogen peroxide. Rates of etching of aluminum that are at least as much as 50 times the rates of etching of titanium under the same conditions can be achieved, and the deoxidizing of the aluminum is satisfactory for achieving corrosion resistance after subsequent conversion coating of the deoxidized aluminum surface.

17 Claims, No Drawings

INHIBITOR FOR AQUEOUS LIQUID DEOXIDIZING COMPOSITION AND PROCESS FOR ALUMINUM, WITH REDUCED ETCHING OF TITANIUM

BACKGROUND OF THE INVENTION

1. Field of the Invention

This invention relates to inhibitors, compositions, and processes for deoxidizing and cleaning surfaces of aluminum and its alloys that contain at least 55% by weight of aluminum (all such alloys being hereinafter to be understood as encompassed within the scope of the term "aluminum" unless the context requires otherwise), while minimizing the etching of titanium. "Deoxidizing" is to be understood herein as the removal from the surface of metals of oxide films and other adherent inorganic materials that would reduce adhesion to subsequently applied protective coatings such as conversion coatings and/or paints and the like, and "cleaning" means removal of all other foreign materials, especially organic soils and poorly adherent inorganic substances such as metal dust and the like, that would reduce adhesion to such subsequently applied protective coatings.

2. Statement of Related Art

With most deoxidizing agents, especially acidic aqueous liquid compositions with substantial hexavalent chromium and/or free fluoride ion contents, such compositions being probably the most effective chemical classes of cleaners and deoxidizers for aluminum now known, there is a perceptible but controlled etching or dissolution of the aluminum, from its surface inward, while the deoxidizing agent is in contact with it. In the aerospace industry in particular, such deoxidizing is considered a necessity for achieving adequate corrosion resistance for many uses of aluminum. The aluminum parts being deoxidized are conventionally held by racks or other structures of titanium during the deoxidizing process, and etching of these titanium structures during the deoxidizing of aluminum is very disadvantageous, as it decreases the lifetime of the titanium structures and would necessitate frequent replacement of these expensive items.

Hexavalent chromium-containing deoxidizing liquid compositions for the types of aluminum alloys most commonly used in aerospace have low etch rates for titanium. However, the pollution problems associated with hexavalent chromium have motivated efforts to eliminate or reduce its use as much as possible. Previously developed chromium-free deoxidizers for aluminum, however, have had unsatisfactorily high etch rates on titanium and/or have required an additional process step compared with conventional deoxidizing of aluminum with the use of hexavalent chromium containing deoxidizing liquid compositions, thereby making them unacceptable to most commercial users.

DESCRIPTION OF THE INVENTION

Object of the Invention

The primary object of the invention is to provide compositions and processes for deoxidizing and cleaning aluminum surfaces with little or no etching of titanium. Another object is to reduce pollution potential from aluminum deoxidizing compositions. Other objects will be apparent from the description below.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole, and any counterions thus implicitly specified should preferably be selected from among other constituents explicitly specified in ionic form, to the extent possible; otherwise such counterions may be freely selected, except for avoiding counterions that act adversely to the objects of the invention; the term "mole" means "gram mole", and "mole" and its grammatical variations may be applied herein, mutatis mutandis, to ionic or any other chemical species with defined numbers and types of atoms, as well as to chemical substances with well defined conventional molecules; and the first definition of an acronym or other abbreviation applies to all subsequent uses of the same acronym or other abbreviation.

SUMMARY OF THE INVENTION

It has been found that a combination of fluoboric and boric acids, together with a stronger acid and an oxidizing agent, provide a fully acceptable rate and quality of deoxidizing aluminum with minimal etch of titanium exposed to the same deoxidizing composition and process. Thus, one embodiment of the invention is an aqueous liquid composition that comprises, preferably consists essentially of, or more preferably consists of, water and:

(A) a component of dissolved acid with a larger ionization constant in water than that of either fluoboric acid or boric acid;

(B) a component of dissolved fluoborate anions; and (C) a component of dissolved boric acid; and, optionally, one or more of the following:

(D) a component of dissolved oxidizing agent that is not part of any of components (A)–(C) as recited above;

(E) a component of stabilizing agent for the oxidizing agent recited in part (D), the stabilizing agent itself not being part of any of components (A)–(D) as recited above;

(F) a component of surfactant that is not part of any of components (A)–(E) as recited above; and (G) a component of dissolved aluminum cations.

Various other embodiments of the invention include: (i) an inhibitor comprising, preferably consisting essentially of, or more preferably consisting of components (B) and (C) as described above; (ii) working compositions for direct use in treating metals, (iii) concentrates and partial concentrates from which such working compositions can be prepared by dilution with water and/or mixing with other chemically distinct concentrates, processes for cleaning and/or deoxidizing aluminum, and extended processes including additional steps that are conventional per se, such as rinsing, conversion coating, painting, or the like. Articles of manufacture including surfaces treated according to a process of the invention are also within the scope of the invention.

At least the most preferred compositions and processes according to the invention meet the deoxidizing requirements of U.S. Military Specification MIL-W-6858C, ¶4.2. and BAC 5765.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002% of each of the following constituents: hexavalent chromium; ferricyanide; silica; silicates; thiourea; pyrazole compounds; sugars; gluconic acid and its salts; glycerine; α-glucoheptanoic acid and its salts; and myoinositol phosphate esters and salts thereof.

Furthermore, in a process according to the invention that includes other steps than a cleaning and/or deoxidizing treatment with a composition as described above, when avoidance of environmental pollution is an important consideration, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. On the other hand, the cleaning and/or deoxidizing process taught herein can be advantageously used prior to chromate conversion coating or anodizing in a chromate containing—or, of course, a non chromate containing—solution, where one of these types of treatment is needed.

Strong acid component (A) is preferably supplied by nitric acid. Other strong and preferably inexpensive mineral or organic acids such as sulfuric, phosphoric, trichloroacetic, acetic, and oxalic acids can also be used. Acids that yield simple halide ions upon ionization in aqueous solution are generally less preferred, because of the danger of pitting corrosion attack on the aluminum being deoxidized. In a working composition according to the invention when component (A) is derived from nitric acid, the concentration of nitric acid preferably is at least, with increasing preference in the order given, 5, 10, 15, 20, 25, 30, 34, 38, 40, 42, 44, or 46 grams per liter of total composition (hereinafter usually abbreviated as "g/L") and independently preferably is, primarily for reasons of economy, not more than, with increasing preference in the order given, 200, 150, 100, 90, 80, 70, 60, 55, 50, or 48 g/L. If another acid than nitric is used, either alone or in a mixture, the preferred concentrations of component (A) in a working composition according to the invention are those that will result in the same pH values, in the complete working composition, as result from using the preferred amounts of nitric acid as specified above.

Component (B), primarily for reasons of economy, is preferably derived from fluoboric acid, although salts of this acid can also be used. The stoichiometric equivalent as $BF_4^-$ anions of all sources of component (B) in a working composition according to the invention preferably is at least, with increasing preference in the order given, 0.4, 0.8, 1.2, 1.6, 2.0, 2.4, 2.8, 3.2, 3.30, 3.40, 3.50, 3.60, 3.70, or 3.80 g/L and independently preferably is, primarily for reasons of economy, not more than, with increasing preference in the order given, 20, 15, 10, 9.0, 8.0, 7.0, 6.0, 5.5, 5.0, 4.5, 4.1, or 3.9 g/L. Independently of the actual concentrations, the ratio of the concentration of the stoichiometric equivalent as $BF_4^-$ onions of all sources of component (B) to the concentration of component (A) when component (A) is nitric acid preferably is at least, with increasing preference in the order given, 0.010:1.0, 0.020:1.0, 0.030:1.0, 0.040:1.0, 0.050:1.0, 0.060:1.0, 0.065:1.0, 0.069:1.0, 0.073:1.0, 0.077:1.0, or 0.081:1.0 and independently preferably is not more than, with increasing preference in the order given, 0.50:1.0, 0.40:1.0, 0.30:1.0, 0.20:1.0, 0.15:1.0, 0.13:1.0, 0.11:1.0, 0.10:1.0, or 0.090:1.0. If another acid or a mixture of acids is used for component (A), these ratios should be adjusted to provide the same pH in working compositions as do the above noted preferred ratios for component (A) when it is derived entirely from nitric acid.

Component (C) preferably is derived from direct addition of simple boric acid, i.e., $H_3BO_3$, but can also be derived from salts of this acid or of (actual or hypothetical) condensed boric acids. In a working composition according to the invention, the concentration as the stoichiometric equivalent as $H_3BO_3$ of all sources of component (C) preferably is at least, with increasing preference in the order given, 0.4, 0.8, 1.2, 1.6, 2.0, 2.4, 2.8, 3.2, 3.30, 3.40, 3.50, 3.60, 3.70, or 3.80 g/L and independently preferably is, primarily for reasons of economy, not more than, with increasing preference in the order given, 20, 15, 10, 9.0, 8.0, 7.0, 6.0, 5.5, 5.0, 4.5, 4.1, or 3.9 g/L. Independently of the actual concentrations, the ratio of the concentration of the stoichiometric equivalent as $H_3BO_3$ of all sources of component (C) to the concentration of component (A) when component (A) is nitric acid preferably is at least, with increasing preference in the order given, 0.010:1.0, 0.020:1.0, 0.030:1.0, 0.040:1.0, 0.050:1.0, 0.060:1.0, 0.065:1.0, 0,069:1.0, 0.073:1.0, 0.077:1.0, or 0.081:1.0 and independently preferably is not more than, with increasing preference in the order given, 0.50:1.0, 0.40:1.0, 0.30:1.0, 0.20:1.0, 0.15:1.0, 0.13:1.0, 0.11:1.0, 0.10:1.0, or 0.090:1.0. If another acid or a mixture of acids is used for component (A), these ratios should be adjusted to provide the same pH in working compositions positions as do the above noted preferred ratios for component (A) when it is derived entirely from nitric acid. Also, independently of the other preferences and of the actual concentrations, the ratio of the concentration of the stoichiometric equivalent as $H_3BO_3$ of all sources of component (C) to the concentration of the stoichiometric equivalent as $BF_4^-$ anions of all sources of component (B) preferably is at least, with increasing preference in the order given, 0.1:1.0, 0.3:1.0, 0.5:1.0, 0.60:1.0, 0.70:1.0, 0.80:1.0, 0.90:1.0, 0.95:1.0, or 0.99:1.0 and independently preferably is not more than, with increasing preference in the order given, 3.0:1.0, 2.5:1.0, 2.0:1.0, 1.8:1.0, 1.6:1.0, 1.4:1.0, 1.30:1.0, 1.20:1.0, 1.10:1.0, or 1.01:1.0.

Component (D) is normally preferably present in a composition according to the invention, unless components (A)–(C) have as much oxidizing power as when the preferred amounts of component (D) as described below are used and component (A) is nitric acid. Component (D) most preferably is made up of hydrogen peroxide, although other peroxides and non-peroxide oxidizing agents can also be used. When only hydrogen peroxide is used for component (D), the concentration of it in a working composition according to the invention preferably is at least, with increasing preference in the order given, 3, 7, 11, 15, 19, 23, 25, 27, 29, 30.0, or 31.0 g/L and independently preferably is, primarily for reasons of economy, not more than, with increasing preference in the order given, 190, 140, 110, 90, 80, 70, 60, 50, 45, 40, 39, 37, 35, 34.0, 33.0, or 32.0 g/L. Independently of the actual concentrations, the ratio of the concentration of component (D) when it is constituted of hydrogen peroxide to the concentration of the stoichiometric equivalent as $H_3BO_3$ of all sources of component (C) preferably is at least, with increasing preference in the order given, 1.0:1.0, 2.0:1.0, 3.0:1.0, 4.0:1.0, 5.0:1.0, 6.0:1.0, 6.5:1.0, 6.9:1.0, 7.3:1.0, 7.7:1.0, or 8.0:1.0 and independently preferably is not more than, with increasing preference in the order given, 50:1.0, 40:1.0, 30:1.0, 20:1.0, 15:1.0, 13:1.0, 11:1.0, 10.0:1.0, 9.0:1.0, 8.6:1.0, 8.4:1.0, or 8.3:1.0; independently of other preferences and of the actual concentrations, the ratio of the concentration of component (D) when it is constituted of hydrogen peroxide to the concentration of the stoichiometric equivalent as $BF_4^-$ of all sources of component (B) preferably is at least, with increasing preference in the order given, 1.0:1.0, 2.0:1.0, 3.0:1.0, 4.0:1.0, 5.0:1.0, 6.0:1.0, 6.5:1.0, 6.9:1.0, 7.3:1.0, 7.7:1.0, or 8.0:1.0 and independently preferably is not more than, with increasing preference in the order given, 50:1.0, 40:1.0, 30:1.0, 20:1.0, 15:1.0, 13:1.0, 11:1.0, 10.0:1.0, 9.0:1.0, 8.6:1.0, 8.4:1.0, or 8.3:1.0; and independently of other preferences and of the actual concentrations, the ratio of the concentration of component (D) when it is constituted of hydrogen peroxide to the concentration of component (A) when component (A) is nitric acid preferably is at least, with increasing preference in the order given, 0.10:1.0, 0.20:1.0, 0.30:1.0, 0.40:1.0, 0.50:1.0, 0.55:1.0, 0.59:1.0, 0.62:1.0, or 0.65:1.0 and independently preferably is not more than, with increasing preference in the order given, 4.0:1.0, 3.0:1.0, 2.0:1.0, 1.5:1.0, 1.3:1.0, 1.1:1.0, 0.90:1.0, 0.85:1.0, 0.80:1.0, 0.75:1.0, 0.70:1.0, or 0.67:1.0. If another oxidizing agent or a mixture of oxidizing agents is used instead of only hydrogen peroxide for component (D), these concentrations and ratios should be adjusted so as to provide the same oxidizing power in the compositions as if they were made with the preferred amounts of hydrogen peroxide recited above; the oxidizing power of the composition may be measured for this purpose by the potential of a platinum electrode immersed in the composition, compared to some standard reference electrode maintained in electrical contact with the composition via a salt bridge, flowing junction, semipermeable membrane, or the like as known to those skilled in electrochemistry. If another acid or a mixture of acids is used for component (A), any ratios involving component (A) should be adjusted to provide the same pH in working compositions as do the above noted preferred ratios for component (A) when it is derived entirely from nitric acid.

Optional component (E) is preferably present in a composition according to the invention when hydrogen peroxide is present therein, as the hydrogen peroxide is likely to decompose during storage in the absence of a stabilizer. Any of a wide variety of stabilizers for hydrogen peroxide that are known in the art may be used, unless they frustrate one of the objectives of the invention. Preferred constituents of component (E) are selected from the group consisting of molecules according to general formula (I):

$$RO(CH_2CH_2O)_y(CH_2CHCH_3O)_zH \quad (I)$$

where: R is a moiety selected from the group consisting of saturated-and-unsaturated straight-and-branched-chain-aliphatic-monovalent-hydrocarbon-moiety-substituent-bearing phenyl moieties in which the aromatic ring is directly bonded to the oxygen atom appearing immediately after the R symbol in formula (I); is a positive integer; and z is zero, one, or two. More preferably, primarily for reasons of economy, the aliphatic portion of the R moiety preferably is saturated, and independently preferably is straight chain or is straight chain except for a single methyl substituent. Also, independently of other preferences: (i) the total number of carbon atoms in the R moiety preferably is at least, with increasing preference in the order given, 8, 10, 11, 12, 13, or 14 and independently preferably is not more than, with increasing preference in the order given, 22, 21, 20, 19, 18, 17, or 16; z is zero; and x is at least, with increasing preference in the order given, 2, 3, 4, 5, 6, 7, 8, or 9 and independently preferably is not more than, with increasing preference in the order given, 15, 14, 13, 12, 11, or 10. In a working composition according to the invention, the concentration of component (E) preferably is at least, with increasing preference in the order given, 0.02, 0.049, 0.077, 0.10, 0.13, 0.15, 0.17, 0.19, or 0.21 g/L and independently preferably is, primarily for reasons of economy, not more than, with increasing preference in the order given, 1.3, 0.98, 0.77, 0.63, 0.56, 0.49, 0042, 0.35, 0.33, 0.31, 0.29, 0.27, 0.25, or 0.23 g/L.

If preferred component (E) as described above is present, optional component (F) is not normally needed, but may be valuable in certain instances, such as if the surfaces to be deoxidized are very irregularly wetted by a composition with components (A)–(E) only.

Optional component (G) of dissolved aluminum cations is not normally included in a fleshly prepared working composition according to the invention, but usually accumulates during use of the composition on aluminum substrates.

One type of concentrate composition according to the invention preferably contains components (A), (B), and (C) as defined above in the same ratios to one another as are desired in the working composition(s) to be made from this type of concentrate composition. In order to maximize the storage stability such a concentrate composition preferably contains not more than, with increasing preference in the order given, 25.0, 24.0, 23.0, 22.0, 21.0, or 20.7% of $HNO_3$. Independently, even if hydrogen peroxide is desired in a working composition according to the invention, it preferably is not present in the same concentrate as any of components (A), (B), and (C) during storage of such a concentrate, as these ingredients reduce the stability of the hydrogen peroxide. Therefore, the hydrogen peroxide preferably is provided in a second concentrate, which contains components (D) and (E) in the same ratio to each other as is desired in the final working composition(s) to be made from the concentrates. In order to promote stability of such a hydrogen peroxide and stabilizer concentrate according to the invention, the concentration of hydrogen peroxide therein preferably is not more than, with increasing preference in the order given, 50, 45, 40, 37, 34, 31, or 29%.

One of the advantages of a deoxidizing composition according to the invention over most prior art is that a composition according to the invention is suitable for use at relatively low temperatures. In particular, primarily for reasons of economy, in a process according to the invention the temperature of the working deoxidizing composition according to the invention preferably is not greater than, with increasing preference in the order given, 50°, 45°, 42°, 40°, or 38° C. and independently, in order to achieve deoxidation in a reasonable time, preferably is at least, with increasing preference in the order given, 15°, 17°, 19°, 21°, or 23° C.

Sufficiency of the deoxidizing effect has been found difficult to judge by any visual indication or other quick method, and the primary practical method found successful so far is to measure the resistance to salt spray of an aluminum surface that has been deoxidized according to the invention and then chromate conversion coated in a conventional manner, such as with products and processing conditions recommended in the Technical Process Bulletins for ALODINE® 600 and 1200S aluminum conversion coating processes available from the Parker Amchem Division of Henkel Corporation (hereinafter usually abbreviated as "PAD"), Madison Heights, Mich., U.S.A. Substrates of Type 2024-T3 aluminum deoxidized according to the invention and then processed according to one of these ALODINE® processes preferably should pass a 336 hour salt spray test. The time of deoxidizing preferably is sufficient to achieve this result. As a general guideline, with the most preferred working compositions according to the invention, a passing salt spray test can generally be achieved with no more than 10 minutes of deoxidizing, and sometimes with no more than 3 minutes. For reasons of economy, of course, the time is preferably not longer than necessary to achieve the required level of deoxidizing to meet performance requirements.

Normally, before being deoxidized according to this invention, an aluminum substrate surface preferably is thoroughly cleaned in a conventional manner, such as with one of the RIDOLINE® cleaner/processes commercially available from PAD.

The practice of this invention may be further appreciated by consideration of the following, non-limiting, working examples, and the benefits of the invention may be further appreciated by consideration of the comparison examples.

EXAMPLES AND COMPARISON EXAMPLES

Test panels of Type 2024-T3 aluminum sheet were subjected to the following process steps in the order shown:

(1) Clean according to the RIDOLINE® 53L process as described in Technical Process Bulletin No. 1291, Edition of May 19, 1992, from PAD.
(2) Rinse with tap water.
(3) Deoxidize by immersion in a composition as shown in detail below.
(4) Rinse with tap water.
(5) Conversion coat according to one of the ALODINE® 600 and 1200S aluminum conversion coating processes as noted above.
(6) Rinse with tap water, dry, and allow to sit for at least 72 hours.
(7) Subject to salt spray testing according to American Society for Testing and Materials Method B-117

Additional details are given in Table 1 below. Blanks in this table indicate that the ingredient shown at the top of the column was not added to the composition on the line where the blank appears.

TABLE 1

DEOXIDIZER COMPOSITIONS

| Identifying Number | Amount in Compositions[1] of: % by Volume of 42 °Baumè Nitric Acid | g/L of $HBF_4$ | g/L of $H_2SiF_6$ | g/L of $H_3BO_3$ | g/L of $Bi_2O_3$ |
|---|---|---|---|---|---|
| 1 | 5 | 1 | | | |
| 2 | 5 | 3 | | | |
| 3 | 5 | 1 | | 5 | |
| 4 | 5 | 3 | | 4 | |
| 5 | 10 | 3 | | 4 | |
| 6 | 5 | | 2 | | |

TABLE 1-continued

DEOXIDIZER COMPOSITIONS

| Identifying Number | Amount in Compositions[1] of: % by Volume of 42 °Baumè Nitric Acid | g/L of $HBF_4$ | g/L of $H_2SiF_6$ | g/L of $H_3BO_3$ | g/L of $Bi_2O_3$ |
|---|---|---|---|---|---|
| 7 | 10 | | 2 | | |
| 8 | 5 | 3 | | 4 | 3 |
| 9 | 10 | 3 | | 4 | 3 |
| 10 | 5 | | 2 | | 3 |
| 11 | 10 | | 2 | | 3 |
| 12 | 5 | | 2 | 4 | 3 |
| 13 | 10 | | 2 | 4 | 3 |
| 14 | 5 | 5 | | 4 | |
| 15 | 10 | 5 | | 4 | |
| 16 | 5 | 3 | | 10 | |
| 17 | 10 | 3 | | 10 | |
| 18 | 5 | 3 | | 4 | |
| 19 | 5 | 3 | | 4 | |

Footnote for Table 1

[1]In each instance the composition also contained from 30 to 32 g/L of $H_2O_2$ and a peroxide decomposition inhibitor, which for all except the last two compositions in the table was TRITON ™ N-101, commercially available from Van Waters & Rogers, Inc., Kirkland, Washington, USA and is reported by its supplier to be a condensation product between ethylene oxide and nonyl phenol having an average molecular weight of 616.

Etch rates and the results of salt spray testing are shown in Table 2 below.

TABLE 2

ETCH RATES AND RESULTS OF SALT SPRAY TESTING

| Identifying Number | Etch Rate in Micrometers/Hour on: 2024-T3 Aluminum | Titanium | Results of 336 Hours Salt Spray Testing[1] |
|---|---|---|---|
| 1 | 1.2–1.8 | 0.25 | Pass |
| 2 | 3.8–5.1 | 0.62 | Marginal |
| 3 | 1.2–1.8 | 0.15 | Pass |
| 4 | 2.5–3.8 | 0.25 | Pass |
| 5 | 2.5–3.8 | 0.05–0.13 | Pass** |
| 6 | 2.5–3.8 | 0.005–0.013 | Fail |
| 7 | 2.5–3.8 | 0.08 | Fail |
| 8 | 2.5–3.8 | 0.005–0.013 | Fail |
| 9 | 2.5–3.8 | 0.08 | Fail |
| 10 | 2.5–3.8 | 0.005–0.020 | Fail |
| 11 | 2.5–3.8 | 0.025–0.051 | Fail |
| 12 | 2.5–3.8 | 0.025 | Fail |
| 13 | 2.5–3.8 | 0.018–0.025 | Not measured |
| 14 | 4.1–5.1 | 0.011 | Pass–Fail* |
| 15 | 4.1–5.1 | 0.015 | Fail |
| 16 | 2.5–3.8 | 0.030 | Pass–Fail* |
| 17 | 2.5–3.8 | 0.038 | Fail** |
| 18 | 2.5–3.8 | 0.08 | Fail |
| 19 | 2.5–3.8 | 0.08 | Fail |

Footnote for Table 2

[1]The results are for conversion coating by an ALODINE ® 600 process, except results suffixed with a single asterisk are for conversion coating by an ALODINE ® 1200S process only, and results suffixed with a double asterisk had the same result for both of these types of conversion coating.

The results in Table 2 indicate that both bismuth oxide and fluosilicic acid are excellent selective inhibitors of titanium etching, but deoxidizing compositions containing only these materials as inhibitors do not achieve the level of salt spray resistance after subsequent conversion coating that is required for the most demanding aerospace applications. These high levels of salt spray resistance are readily achieved by compositions according to the invention, such as those with identifying numbers 3, 4, 14, and 16 above, that also have acceptably low etch rates for titanium.

The invention claimed is:

1. A process for deoxidizing and etching an aluminum surface that is in contact with a titanium surface, by contacting both the aluminum and the titanium surfaces with an aqueous liquid composition that spontaneously deoxidizes end etches the aluminum surface by chemical reaction therewith, wherein: the rate of etching of the titanium surface is not greater than 0.25 micrometers per hours; the aqueous liquid composition comprises water and:

(A) a component of dissolved acid with a larger ionization constant in water than fluoboric acid or boric acid;

(B) a component of dissolved fluoborate anions; and (C) a component of dissolved boric acid;

and the aqueous liquid composition comprises not more than about 0.35% of hexavalent chromium.

2. A process according to claim 1, wherein, in the aqueous liquid composition: component (A) is nitric acid and is present in a concentration from about 5 to about 200 g/L; component (B) is present in a concentration that has a ratio to the concentration of component (A) within a range from about 0.01:1.0 to 0.50:1.0; and component (C) is present in a concentration that has a ratio to the concentration of component (B) within a range from about 0.1:1.0 to 3.0:1.0.

3. A process according to claim 2, wherein: the concentration of nitric acid is from about 10 to about 100 g/L; the ratio of the concentration of component (B) to the concentration of component (A) is from about 0.030:1.0 to about 0.20:1.0; and the ratio of the concentration of component (C) to component (B) is from about 0.50:1.0 to about 2.0:1.0.

4. A process according to claim 3, wherein: the concentration of nitric acid is from about 20 to about 70 g/L; the ratio of the concentration of component (B) to the concentration of component (A) is from about 0.060:1.0 to about 0.15:1.0; and the ratio of the concentration of component (C) to component (B) is from about 0.70:1.0 to about 1.6:1.0.

5. A process according to claim 4, wherein: the concentration of nitric acid is from about 34 to about 55 g/L; the ratio of the concentration of component (B) to the concentration of component (A) is from about 0.073:1.0 to about 0.13:1.0; and the ratio of the concentration of component (C) to component (B) is from about 0.80:1.0 to about 1.3:1.0.

6. A process according to claim 5, wherein the rate of etching of the titanium surface is not more than about 0.030 micrometers per hour and the aqueous liquid composition comprises not more than about 0.10% of hexavalent chromium.

7. A process according to claim 4, wherein the rate of etching of the titanium surface is not more than about 0.030 micrometers per hour and the aqueous liquid composition comprises not more than about 0.10% of hexavalent chromium.

8. A process according to claim 3, wherein the rate of etching of the titanium sure is not more than about 0.030 micrometers per hour and the aqueous liquid composition comprises not more than about 0.10% of hexavalent chromium.

9. A process according to claim 2, wherein the rate of etching of the titanium surface is not more than about 0.15 micrometers per hour.

10. A process according to claim 1, wherein the rate of etching of the titanium surface is not more than about 0.15 micrometers per hour.

11. An aqueous liquid composition that is suitable either as such, after dilution with water, or both as such and after dilution, for deoxidizing etching of aluminum surfaces by contact therewith, said composition comprising water and:

(A) a component of dissolved acid with a larger ionization constant in water than fluoboric acid or boric acid;

(B) a component of dissolved fluoborate anions; and (C) a component of dissolved boric acid; and, optionally, one or more of the following:

(D) a component of dissolved oxidizing agent that is not part of any of components (A)–(C) as recited above;

(E) a component of stabilizing agent for the oxidizing agent recited in part (D), the stabilizing agent itself not being part of any of components (A)–(D) as recited above;

(F) a component of surfactant that is not part of any of components (A)–(E) as recited above; and (G) a component of dissolved aluminum cations.

12. A composition according to claim 11 that is a concentrate, wherein: component (A) is nitric acid and is present in an mount from about 10 to about 25.0 g/L; component (B) is present in a ratio of stoichiometric equivalent as $BF_4^-$ anions to component (A) from about 0.010:1.0 to about 0.50:1.0; and component (C) is present in a ratio of stoichiometric equivalent as $H_3BO_3$ to stoichiometric equivalent as $BF_4^-$ anions in component (B) from about 0.3:1.0 to about 3.0:1.0.

13. A composition according to claim 12, wherein: component (A) is present in an amount from about 15 to about 20.7 g/L; component (B) is present in a ratio of stoichiometric equivalent as $BF_4^-$ anions to component (A) from about 0.081:1.0 to about 0.090:1.0; and component (C) is present in a ratio of stoichiometric equivalent as $H_3BO_3$ to stoichiometric equivalent as $BF_4^-$ anions in component (B) from about 0.95:1.0 to about 1.10:1.0.

14. A working composition according to claim 11, wherein: component (A) is nitric acid and is present in an amount from about 5 to about 200 g/L; component (B) is present in an amount from about 0.4 to about 20 g/L; component (C) is present in an amount from about 0.4 to about 20 g/L; and the composition also comprises from about 7 to about 140 g/L of hydrogen peroxide.

15. A working composition according to claim 14, wherein: component (A) is nitric acid and is present in an amount from about 45 to about 50 g/L; component (B) is present in an amount from about 3.70 to about 4.1 g/L; component (C) is present in an amount from about 3.70 to about 4.1 g/L; the composition comprises from about 29 to about 34.0 g/L of hydrogen peroxide; and the composition also comprises at least about 0.15 g/L of peroxide decomposition inhibitors selected from the group consisting of molecules conforming to general formula (I):

$$RO(CH_2CH_2O)_y(CH_2CHCH_3O)_zH \quad (I)$$

where: K is a moiety selected from the group consisting of saturated-and-unsaturated straight-and-branched-chain-aliphatic-monovalent-hydrocarbon-moiety-substituent-bearing phenyl moieties in which the aromatic ring is directly bonded to the oxygen atom appearing immediately after the R symbol in formula (I); y is a positive integer; z is zero or one; the aliphatic portion of the R moiety is saturated and straight chain, or straight chain except for a single methyl substituent; the total number of carbon atoms in the R moiety preferably is from about 14 to about 17; and the average value of y is from 8 to 11.

16. A process of deoxidizing an aluminum surface, by contacting it for a deoxidizing effective time with a composition according to claim 15.

17. A process of deoxidizing an aluminum surface, by contacting it for a deoxidizing effective time with a composition according to claim 14.

* * * * *

UNITED STATES PATENT AND TRADEMARK OFFICE

CERTIFICATE OF CORRECTION

PATENT NO. : 5,637,252

DATED : June 10, 1997

INVENTOR(S) : Phillip M. Johnson; Lawrence R. Carlson

It is certified that error appears in the above-identified patent and that said Letters Patent is hereby corrected as shown below:

In the ABSTRACT, the first line, insert --free-- after the word –ferricyanide so that the line reads.....
"A chromium-and-ferricyanide-free non-aqueous cleaner/".....

Signed and Sealed this

Eighth Day of May, 2001

*Attest:*

Nicholas P. Godici

NICHOLAS P. GODICI

*Attesting Officer*

*Acting Director of the United States Patent and Trademark Office*